United States Patent [19]

Vidal

[11] Patent Number: 5,040,928

[45] Date of Patent: Aug. 20, 1991

[54] FACINGS FOR EARTHWORKS

[75] Inventor: Henri Vidal, Neuilly-sur-Seine, France

[73] Assignee: Societe Civile des Brevets de Henri Vidal, Puteaux Cedex, France

[21] Appl. No.: 270,026

[22] Filed: Nov. 14, 1988

[30] Foreign Application Priority Data

| | | | |
|---|---|---|---|
| Nov. 13, 1987 | [GB] | United Kingdom | 8726636 |
| Feb. 1, 1988 | [GB] | United Kingdom | 8802131 |
| Apr. 29, 1988 | [GB] | United Kingdom | 8810184.5 |

[51] Int. Cl.[5] ..... E02D 29/02

[52] U.S. Cl. ..... 405/284; 405/262

[58] Field of Search ..... 405/258, 272, 262, 284, 405/285, 286, 20

[56] References Cited

U.S. PATENT DOCUMENTS

| | | | |
|---|---|---|---|
| 3,386,252 | 6/1968 | Nelson | 405/20 |
| 3,686,873 | 8/1972 | Vidal | 405/262 |
| 3,999,398 | 12/1976 | Kurose | 405/262 |
| 4,514,113 | 4/1985 | Neumann | 405/286 |
| 4,616,959 | 10/1986 | Hilfiker | 405/286 |
| 4,923,339 | 5/1990 | Smith | 405/284 |

FOREIGN PATENT DOCUMENTS

| | | | |
|---|---|---|---|
| 2348043 | 8/1974 | Fed. Rep. of Germany | 405/286 |
| 113421 | 7/1983 | Japan | 405/286 |
| 59-130922 | 7/1984 | Japan . | |
| 2139676 | 11/1984 | United Kingdom . | |

*Primary Examiner*—David H. Corbin

*Attorney, Agent, or Firm*—Burns, Doane, Swecker & Mathis

[57] ABSTRACT

A facing for an earthwork includes an array of polygonal frames that are connected to the forward ends of stabilizing elements which are embedded in the soil. The polygonal frames are flexibly connected to each other at their corners by joints which allow independent movement of each frame in the plane of the facing without movement in a direction perpendicular to the plane of the facing. Each frame includes a cover which is capable of limited resilient forward movement in a direction perpendicular to the frame and which is capable of resisting the pressure of the soil.

36 Claims, 19 Drawing Sheets

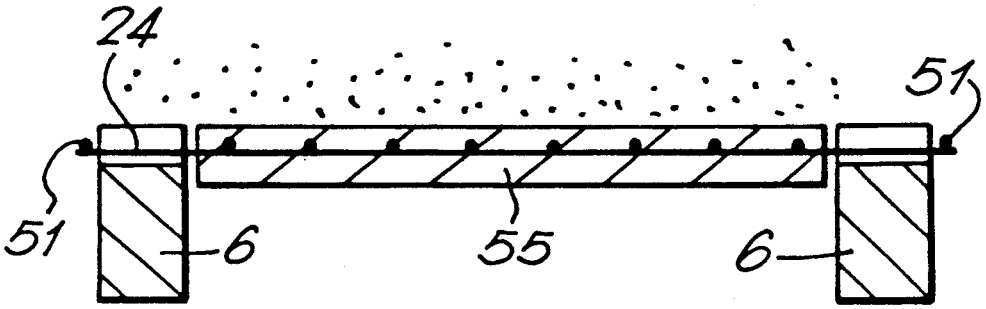
FIG. 9.
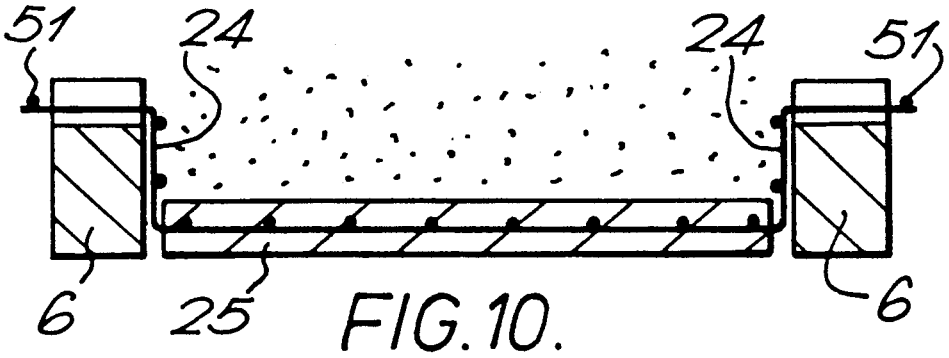
FIG. 10.
FIG. 15.
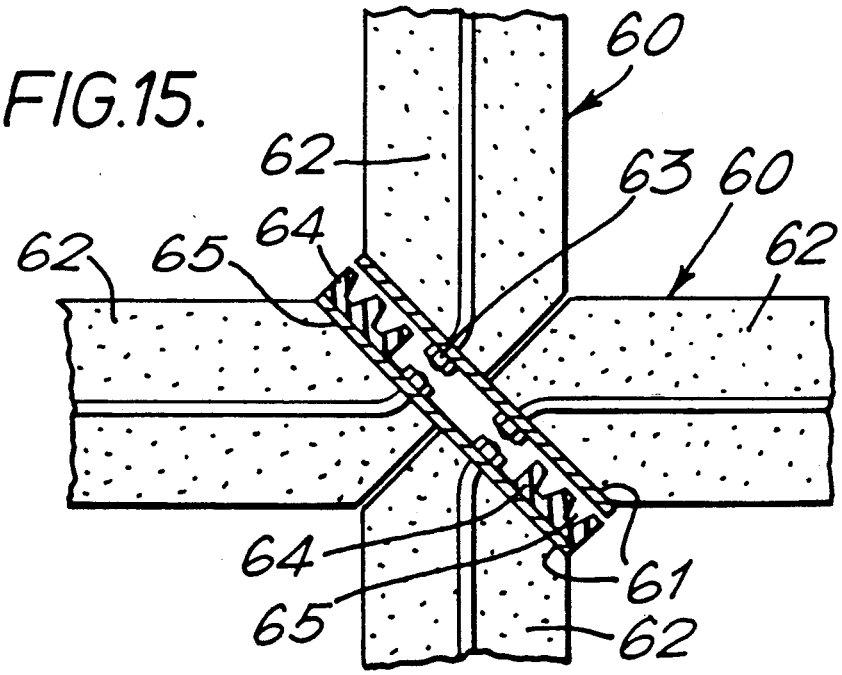

FIG.16.
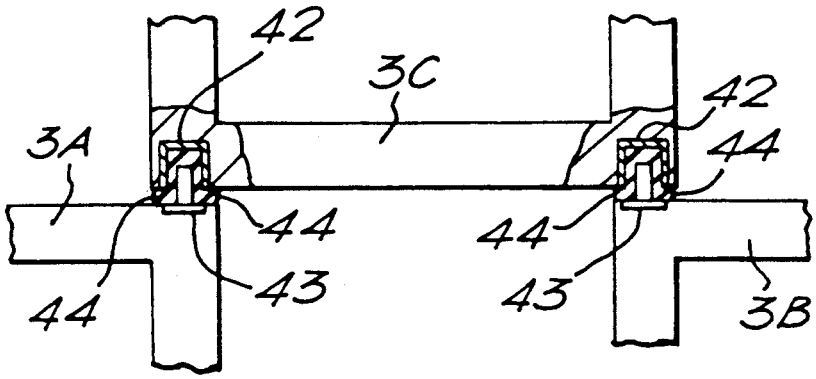
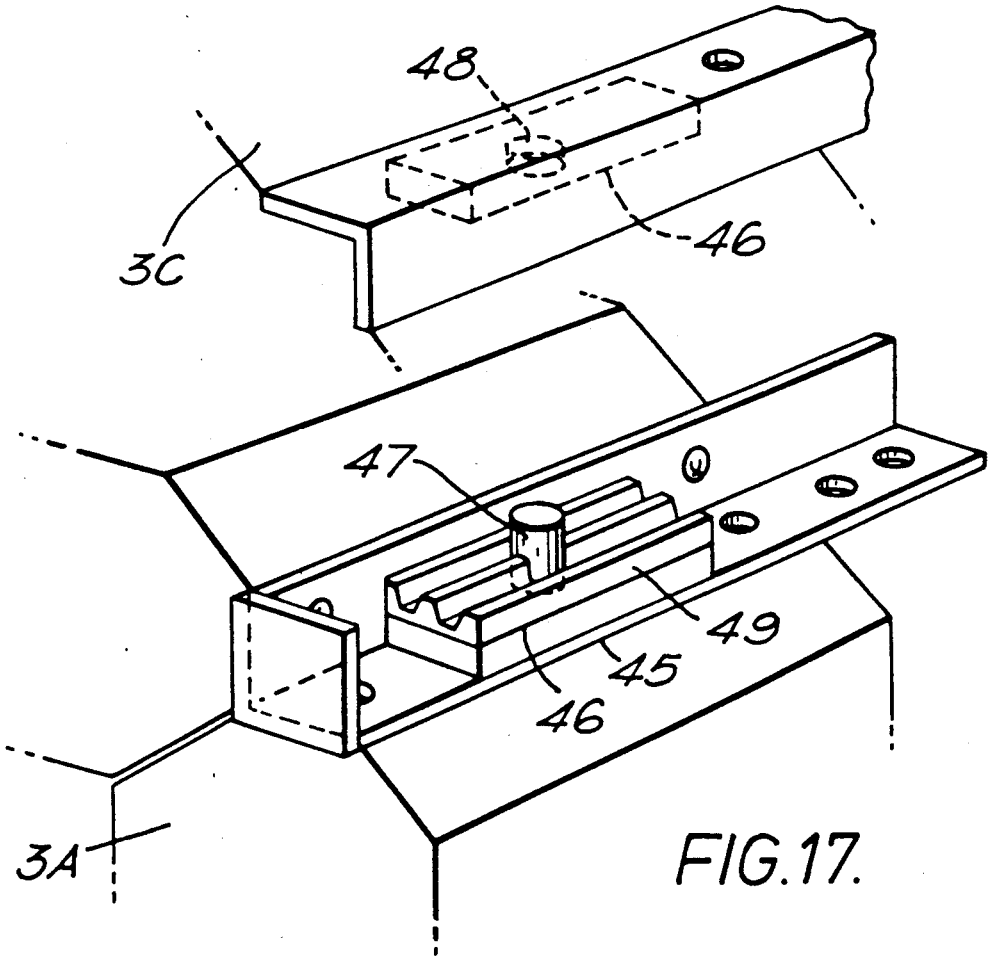
FIG.17.

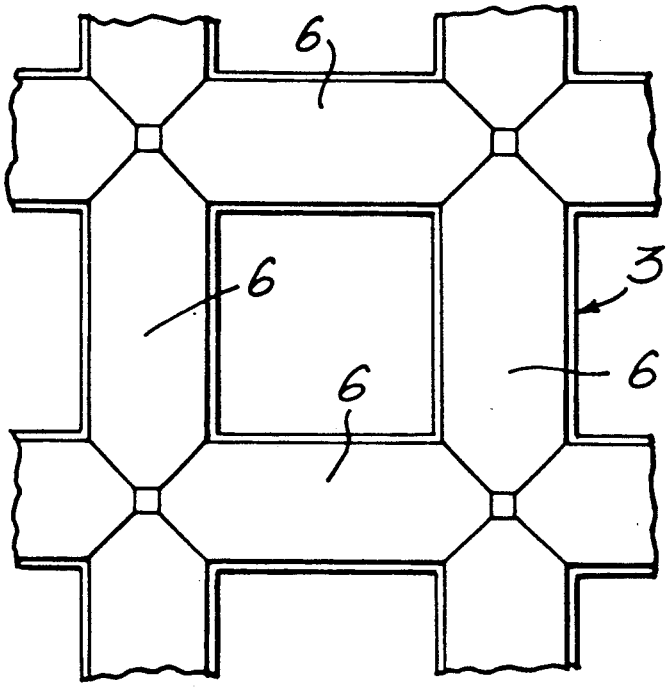
FIG.19.
FIG.18.
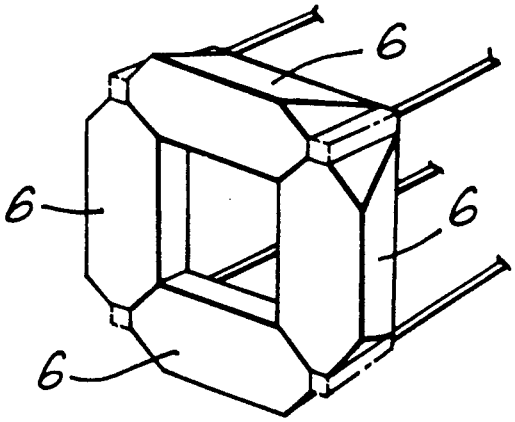
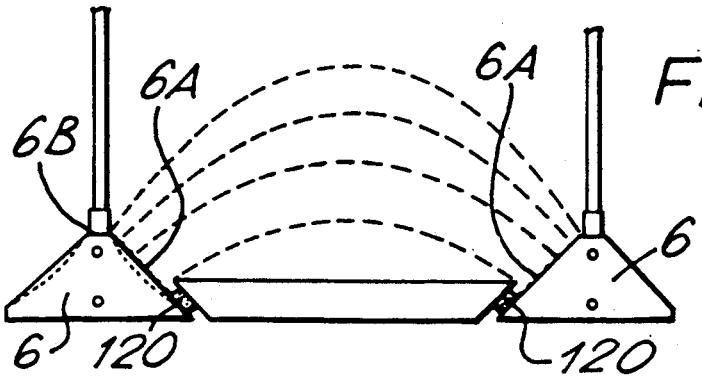
FIG.20.

FIG. 21.
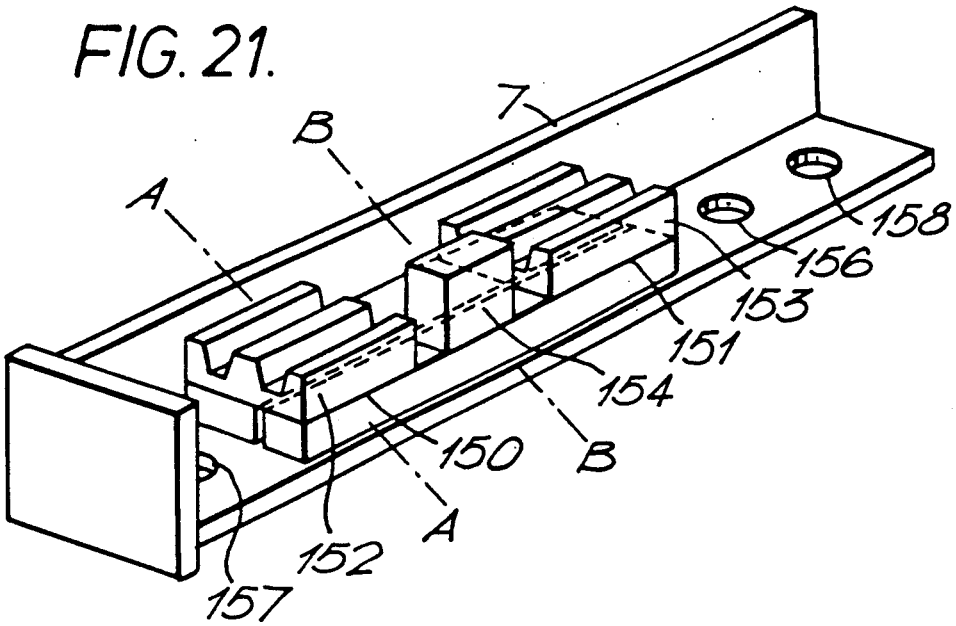
FIG. 22.
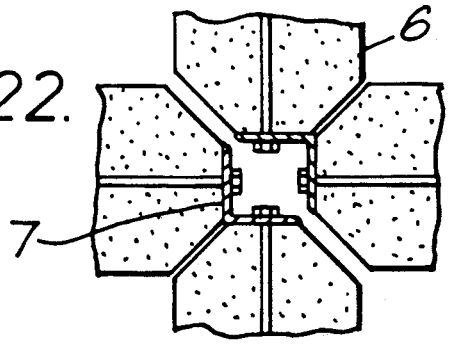
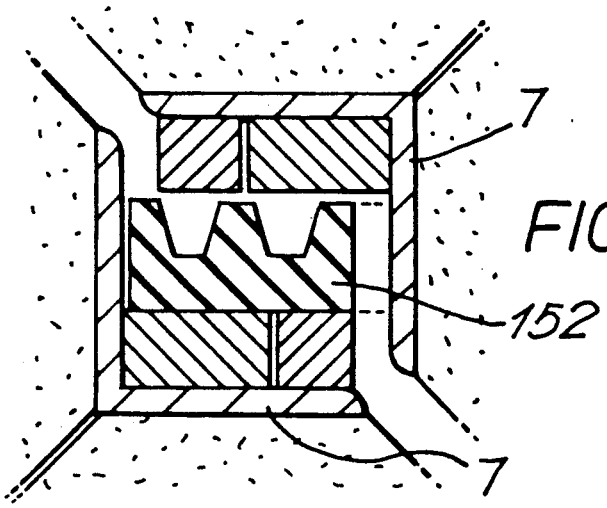
FIG. 23.

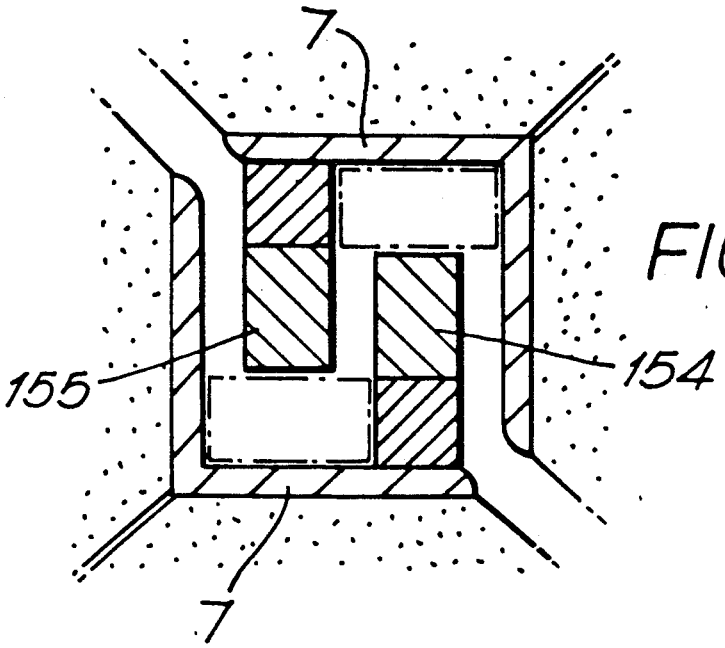
FIG. 24.
FIG. 25.
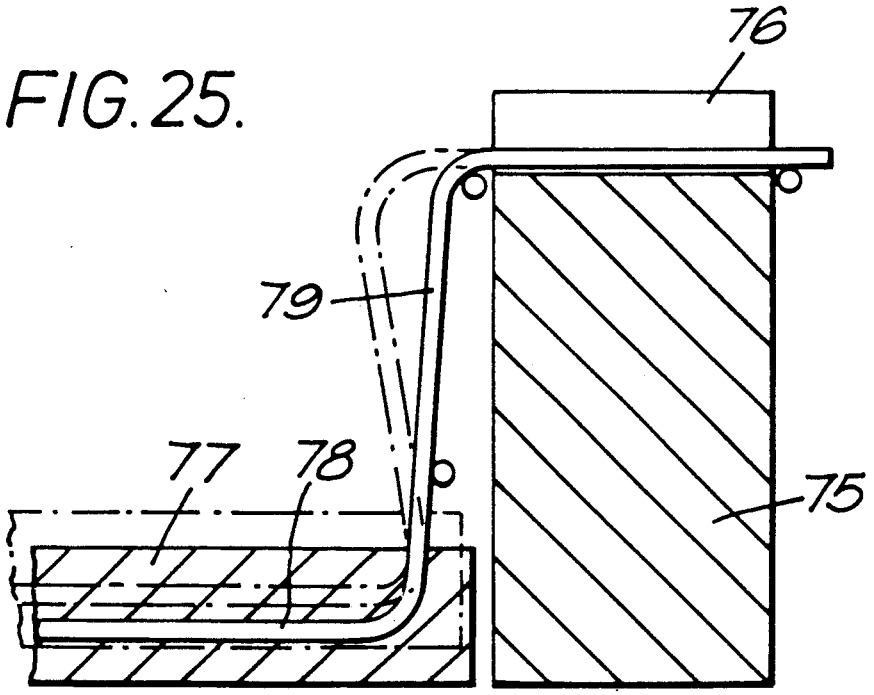

83
81
80
C
C
89
B
B
88
87
130
82
A
A

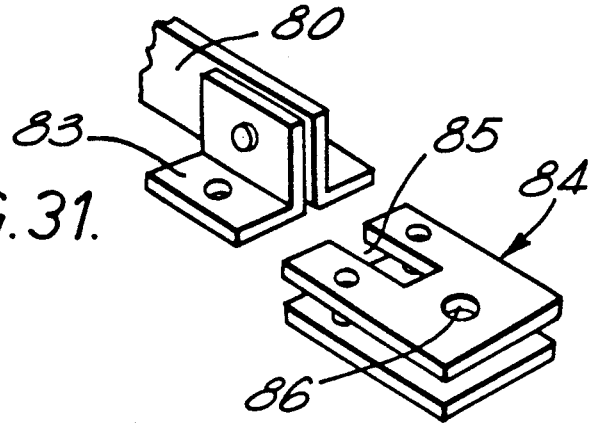
FIG. 31.
FIG. 32.
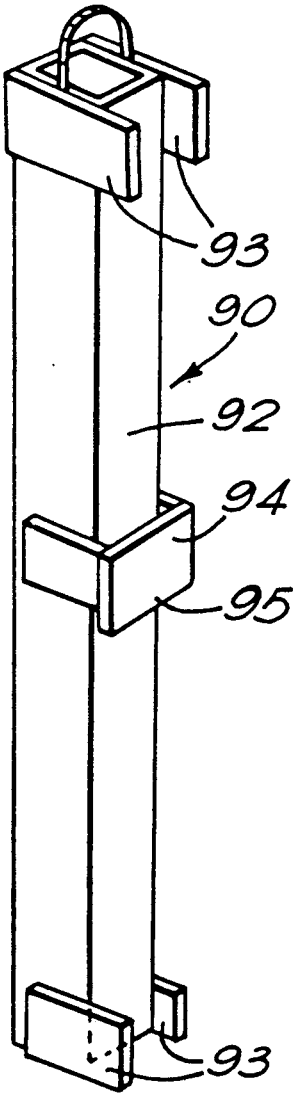
FIG. 33.
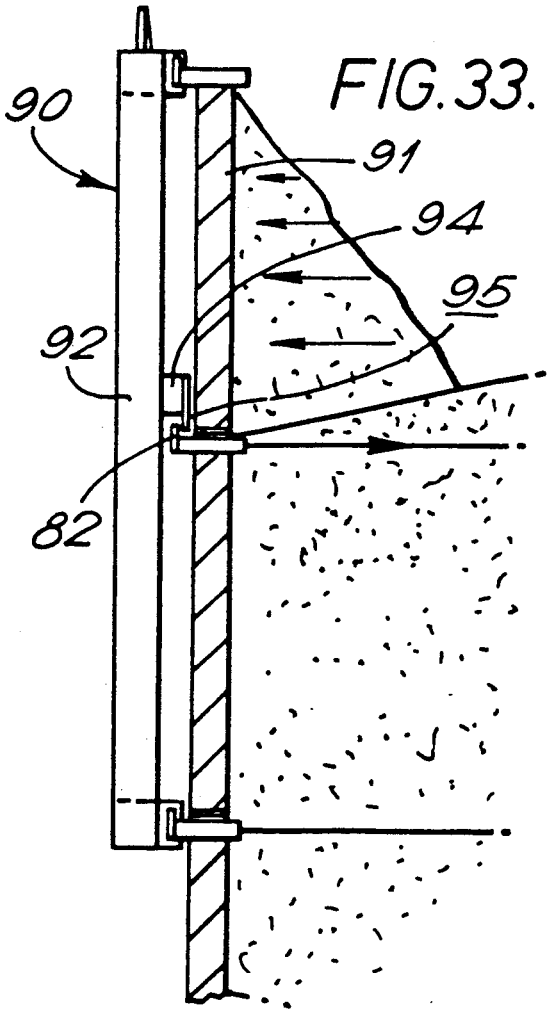

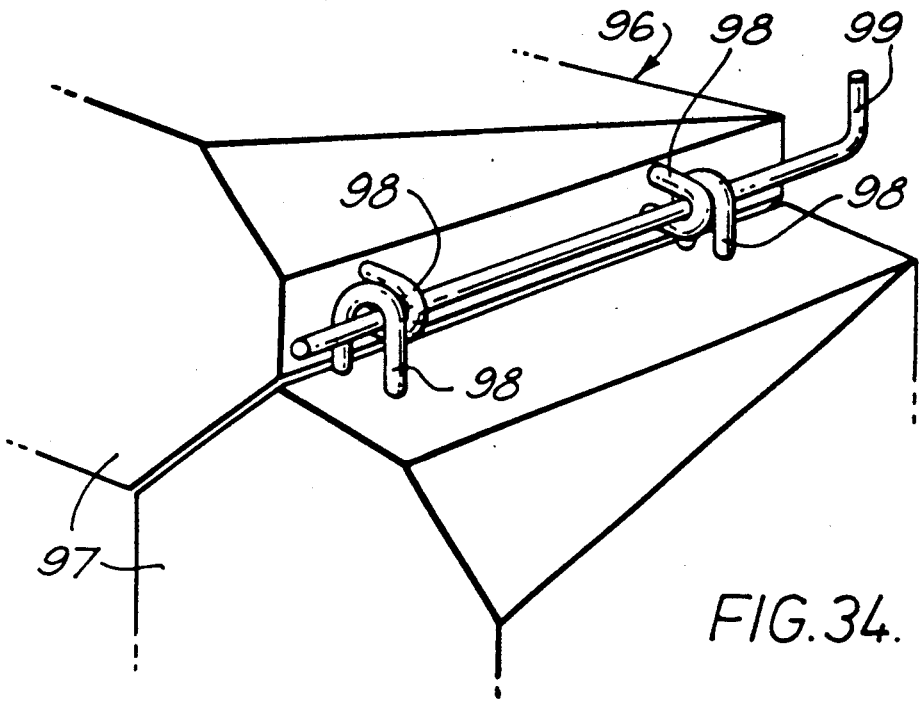
FIG. 34.
FIG. 35.
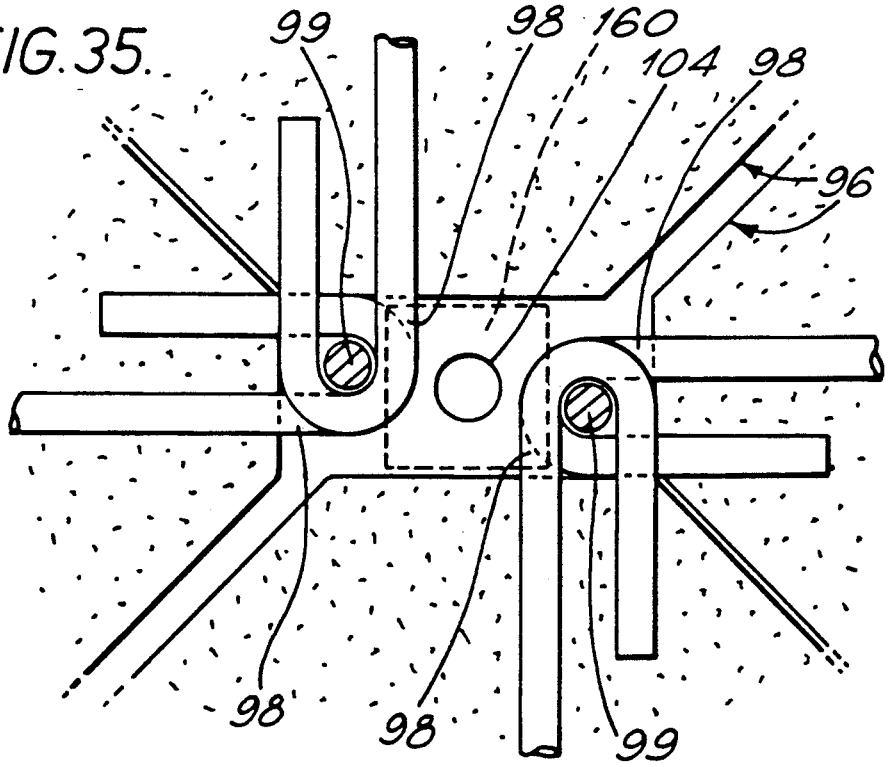

FACINGS FOR EARTHWORKS

FIELD OF THE INVENTION

This invention concerns improvements in or relating to facings for earthworks.

BACKGROUND OF THE INVENTION

Facings for earthworks are conventionally relatively thick in order to withstand earth pressures, even when the earth is stabilized for example by inclusion of stabilizing members such as reinforcement strips or grids, anchor systems or soil nails. However, even the somewhat thinner facings used hitherto with stabilized earth systems, for example reinforced concrete panels, of about 14–25 mm thickness, have been found to be rather expensive, particularly for use in small structures, and there is a demand for an alternative, less expensive facing system.

Japanese Patent Application 59-130922 has proposed construction of the facing of such a stabilized earth system by attaching to the ends of the reinforcements an array of rectangular metal frames, welded or bolted at their abutting corners. The frames may carry panels which abut to provide a substantially continuous facing. However, we have found that such a structure in which the frames are connected to form a rigid framework does not accommodate movements of the earth structure during compaction or any subsequent settlement and that it is essential that each panel of such an array must be capable of some independent movement relative to adjacent panels, particularly in the vertical direction, in order to avoid large vertical stresses in the facing.

SUMMARY OF THE INVENTION

According to the present invention therefore we provide a facing for an earthwork comprising an array of polygonal frames flexibly connected to each other to allow independent movement of each frame in the plane of the facing, said array being provided with means for attachment to said earthwork substantially to prevent movement of said frames in a direction perpendicular to the plane of the facing.

The invention also extends to an earth structure having secured thereto a facing according to the invention. The invention further includes a method of constructing a facing according to the invention by assembling said frames in rows to provide said array.

The term earthwork as used herein is intended to include man-made earth structures and also natural earth structures including rock faces.

The facing according to the invention is particularly adapted for attachment to the ends of stabilizing elements embedded in the earth. Such stabilizing elements may include reinforcing strips as described in British Patent Nos. 1563317 and 1324686 or grids or other elements embedded in layers in the earth, for example using the Reinforced Earth technique described in said British patents; other stabilizing elements include tie-rods attached to anchors or "deadmen" embedded in the earth at the rear of the structure, as well as soil nails driven into existing earth masses (including rock masses).

The permitted movement of the frames in the plane of the facing should be sufficient to accommodate those movements of the earth structure which are found in practice. In general the movement of each frame in any direction in the plane of the facing, particularly the vertical direction is preferably at least 0.25%, more preferably at least 0.5%, most preferably at least 1.0% of the dimension of the frame in that direction. In general the movement of each frame will be less than 3%, more usually less than 2% of the dimension of the frame in that direction. In general, greater vertical spacing of the frames will be required where substantial vertical movement of the earth fill is expected after compaction for example when the fill is relatively lightly compacted during construction or where the earth structure is relatively high. Lateral movement of the frames needs to be accommodated to allow for the possibility of different vertical movements of the fill at points along the facing thus requiring the frames to tilt slightly in the plane of the facing.

In a preferred form of the structure according to the invention, the corners of the polygonal frames are adapted to one another via securing means permitting relative movement of said corners. Thus, for example, the securing means may comprise pins or lugs adapted to cooperate with holes or slots in the opposed corners of vertically adjacent frames, suitable resilient bearing means being provided to ensure the required movement of the frames in the plane of the facing. Such securing means may also, for example, comprise 'nails' each having a shank carrying resilient bearing means which engage with shaped surfaces at the corners of the frames to permit the required movement in the plane of the facing, and preferably a head portion which engages with the front of each polygonal frame to prevent forward movement perpendicular to the plane of the facing.

Thus for example, the frames may be provided at their corners with channels perpendicular to the plane of the frame which cooperate with the resilient bearing and the securing means.

In the case of rectangular frames, the facing may advantageously comprise spaced frames arranged to abut only at their corners, as in the arrangement of the black squares of a chess board. Thus, the frames in each horizontal row may be spaced laterally by about one frame width and the frames of the vertically adjacent rows will join the corners of said spaced frames. In this way, there will only be two frames abutting at each point of contact and the securing means will advantageously include resilient bearing means positioned between two L-shaped channels, each channel being provided by a respective frame. The resilient bearing means may be a rubber material preferably formed with external grooves to increase flexibility and facilitate relative movement of the polygonal frames. The corners of the frames may advantageously be provided with locating means such as the above mentioned pins or lugs which cooperate with the corners of vertically adjacent frames to permit limited lateral movement while assisting in locating the frames in their correct positions during assembly. Each lug may be in the form of a projecting end portion of a member embedded in the frame body, for example a concrete reinforcing bar.

Nail securing means are advantageously provided with means for attachment to the ends of stabilizing elements, for example a suitably placed hole through an extended portion of the shank. However, it is also possible for the frames to be attached to stabilizing elements directly, via lugs projecting rearwardly therefrom and having a hole for a bolt connection to the stabilizing element. Such lugs may conveniently, for example, be extensions of the metal bearing surfaces at the corners of the frames or may be located at the mid points of the individual frame side-members.

The frames are advantageously constructed from uniform members comprising the sides of the polygonal shape required. This provides the advantage of simplicity of production and transport. The frames will normally be each constructed prior to assembly, for example by bolting to shaped metal brackets which, in a preferred form, may also serve as the shaped surfaces, e.g. channels, which abut the flexible bearing surfaces. The side members may also conveniently be assembled to form frames by bolting through holes running diagonally through the abutting side members at each corner of the frame. Alternatively the frames may be assembled in situ from the side members and if so it may be desirable temporarily to stiffen each frame during construction by using a bar extending between diagonally opposite corners.

In an alternative embodiment, the polygonal frames may be provided at their corners with diagonal bearing surfaces which, when the framework is assembled, are separated by resilient bearing means. In this case, the diagonal bearing surface may be a metal plate serving also as securing means in the assembly of the frame, for example by cooperation with bolts protruding from the separate side members of the frame. One or both of the diagonal plates may conveniently be provided with means for attachment to the earthwork, for example a short linkage so shaped as to permit one end to be bolted to the diagonal plate while the other end is bolted to the substantially horizontal end of a stabilizing element in the earth. In such an embodiment, it may be convenient to provide at each pair of bearing surfaces a pin cooperating with holes in the respective frames to prevent relative movement of the frames perpendicular to the plane of the facing. However, this is not essential, for example where both of the diagonal plates are secured to stabilizing elements or to each other.

It is desirable to provide means whereby, 5 during construction, the frames cannot overturn in the forward direction. This is conveniently achieved by extending the metal plates providing bearing surfaces at the corners of the frames sufficiently far rearwards to permit a bolt to join the two abutting plates and thus prevent their separation at that point. Alternatively, a strong substantially rectangular ring member, e.g. of steel, may be slid over the said extended metal plates to prevent such separation while not hindering the required vertical movement of the frames. It is also desirable to provide means for keeping the horizontal front surfaces of such plates apart to prevent rotation of the upper frame due to compression of the resilient bearing material, for example a bolt which can subsequently be removed. Tilting of an upper frame may also be prevented by using an elongate device which hooks on to an appropriately adapted portion a the front of the metal plates and which extends vertically to engage both a lower frame and the upper frame.

The side members of the frames are desirably of sufficient depth in the direction perpendicular to the plane of the facing to provide adequate strength and stability. In the case of concrete frames, the side members may, for example have a thickness of 100–200 mm, e.g. 130 mm, a length of 1000 to 1500 mm, e.g. 1350 mm, and a width of 200–300 mm e.g. 240 mm.

The polygonal frames will normally be provided with covers which serve to retain the soil. We have found that it is particularly desirable if such covers are capable of resilient movement relative to the frame in the direction perpendicular to the frame, at least over the greater part of their area, while resisting the pressure of the soil. If the covers are rigidly connected to the frames and are not capable of forward movement, the pressure of the soil on the rear of the structure is distributed uniformly and will thus be relatively large in the central area of each frame. By providing the possibility of resilient forward movement of the covers, pressure on the central area of the frame is reduced. Since the frame itself is not capable of movement perpendicular to the facing, it will bear the full pressure of the soil. However, under these circumstances the compressive force provided by the edges of the frame will be transmitted to the soil behind the central area of the frame by the phenomenon of arching. Thus, when the cover moves forward slightly, it is found that the whole volume of earth behind the frame is supported by the arching forces generated by the frame. Once the cover has moved in this way an equilibrium will be established between the relatively reduced force on the cover and the resilience provided by the mounting of the cover.

The side members of the frames may advantageously be narrower at the rear than at the front, thus providing a rear-facing angled surface which will generate compressive forces in the adjacent soil angled towards each other from opposite sides of the frame, thereby assisting establishment of the arching phenomenon. It may be advantageous to provide grooves or ridges on the said angled rear surfaces to enhance frictional contact with the soil and more efficient transmission of compressive arching forces.

Thus, the covers may be constructed from flexible, resilient material of adequate strength to resist soil pressure, for example a plastic or metal mesh secured at the edges to the frame but allowing soil movements of at least one or two cm at the center for a 1.5 meter frame. Alternatively, solid or other panels which are relatively rigid may be mounted on the frames in such a way as to permit relative movement perpendicular to the facing. If necessary, a flexible bearing can be interposed between the cover and the frame to permit such movement while maintaining a firm connection. This flexible bearing may be made from flexible material such as rubber or foamed polystyrene or may be a form of spring which allows forward movement e.g. a cylindrical pipe or a U-shaped section of metal which can compress. Alternatively, the required resilient movement may be provided by deformability of the connection between the cover and the frame which connection can comprise lateral, resilient projections, for example relatively thin shaped metal bars, e.g. the elements of metal grids, which fit into slots at the rear of the frames and deform under the action of the earth pressure. Thus, the cover may move in the frame, thereby reducing the earth pressure and eventually reaching an equilibrium position. The cover is conveniently mounted on the soil side of the frame but may be mounted inside the frame or even at the front. The cover elements should not themselves be so closely spaced that they interfere with the free movement of the individual frames.

In general, the covers should be free to move 1–3, e.g. 2 cm in the perpendicular direction i.e. about 0.5% to 2% of the length of each side of the frame.

BRIEF DESCRIPTION OF THE DRAWINGS

Some preferred embodiments of the invention will now be described by way of example and with reference to the accompanying drawings, in which:

FIGS. 9 and 10 are sectional views of alternative covers for the facing frame;

FIG. 15 is a section through another embodiment of a flexible connection between facing frames, parallel to the plane of the facing;

FIG. 16 is a section through a still further embodiment of a flexible connection between facing frames parallel to the plane of the facing using an elongate lug locating means;

FIG. 17 shows a section through a further embodiment of a flexible connection using a pin locating means;

FIG. 18 shows a frame constructed from side members which are narrower at the rear than at the front;

FIG. 19 shows an array of the frames of FIG. 18;

FIG. 20 shows a horizontal section through a frame as shown in FIG. 18 and includes a resiliently mounted cover;

FIG. 21 shows a perspective view of a channel member for use with a frame as in FIG. 18;

FIG. 22 shows a section through abutting corners of frames carrying the channel members of FIG. 21;

FIG. 23 shows a section through two abutting channel members of FIG. 21 along the line A—A;

FIG. 24 shows a section through two abutting channel members of FIG. 21 along the line B—B;

FIG. 25 shows a side member of a frame according to the invention together with part of an associated resiliently mounted cover;

.

FIG. 31 shows a perspective view of attachment means for a stabilizing element at the rear of the flexible joint shown in FIG. 26;

FIG. 32 shows a device for temporarily stabilizing the facing frames of FIGS. 26 to 31 during construction;

FIG. 33 shows the stabilizing device of FIG. 32 in use during construction;

FIG. 34 shows a perspective view of another form of flexible connection;

FIG. 35 shows a section through the connection of FIG. 34 parallel to the plane of the facing;

DETAILED DESCRIPTION OF THE PREFERRED EMBODIMENTS

Figure 1:
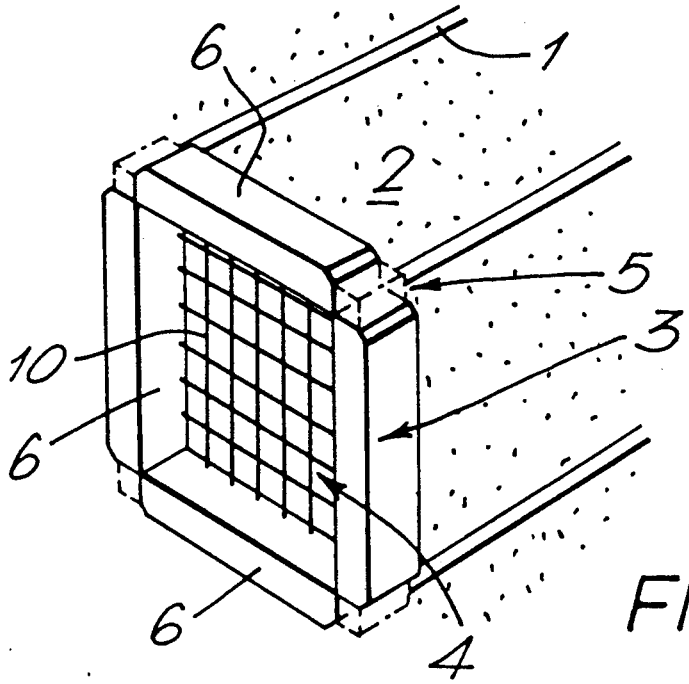
FIG. 1 is a schematic perspective view of part of a structure according to the invention.
Figure 2:
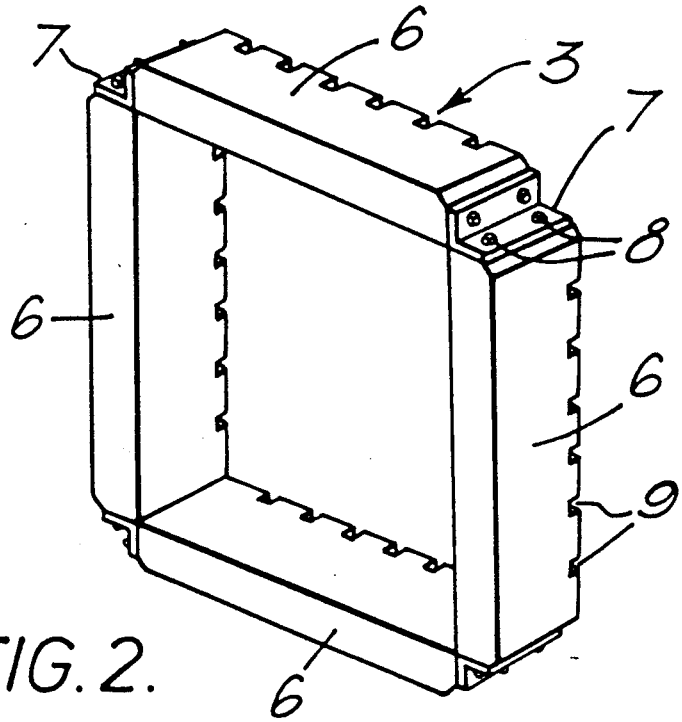
FIG. 2 is a perspective view of a facing frame of the structure.
Figure 3:
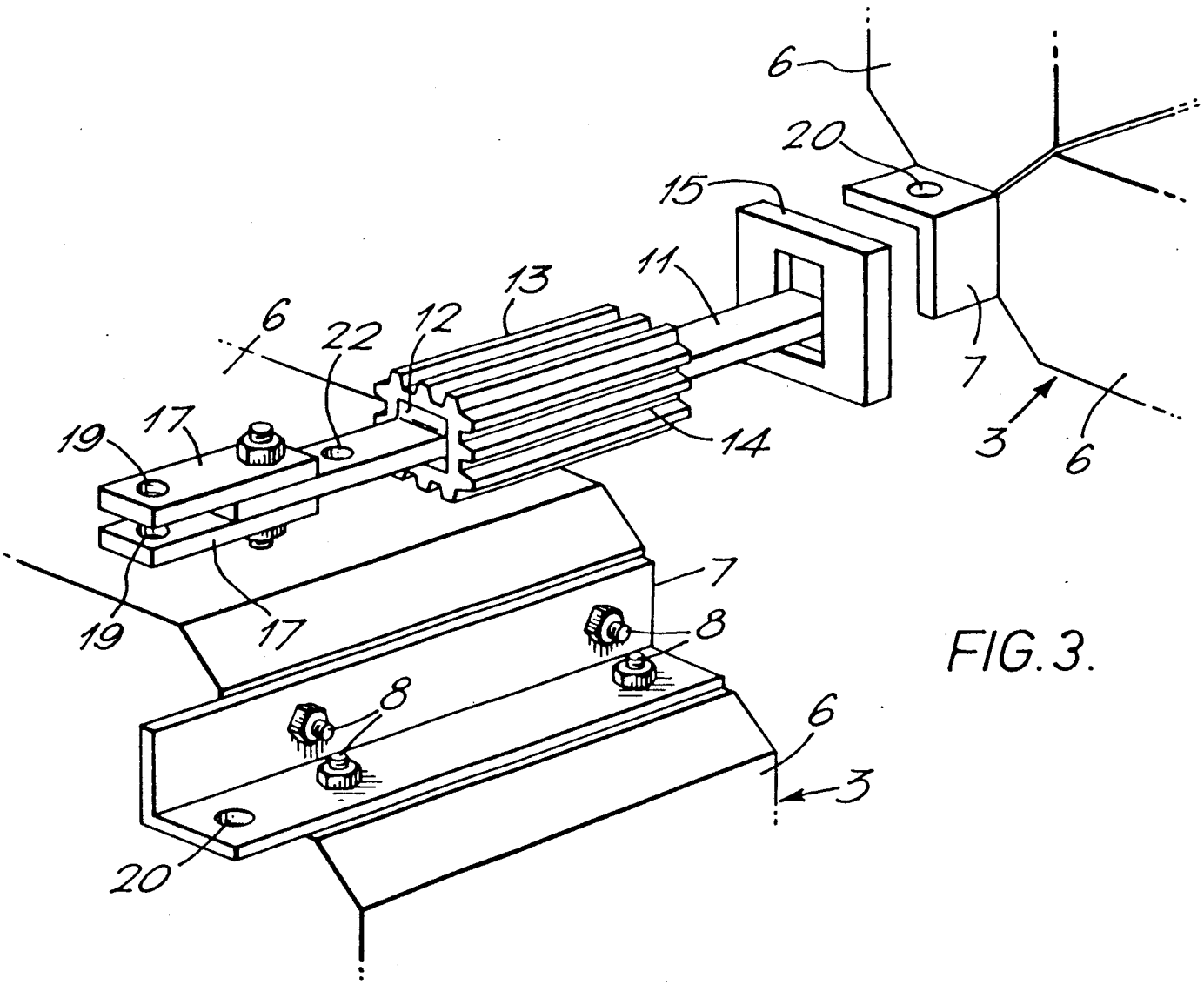
FIG. 3 is an exploded perspective view of the corners of a pair of facing frames and the securing means for flexibly connecting the frames.
Figure 4:
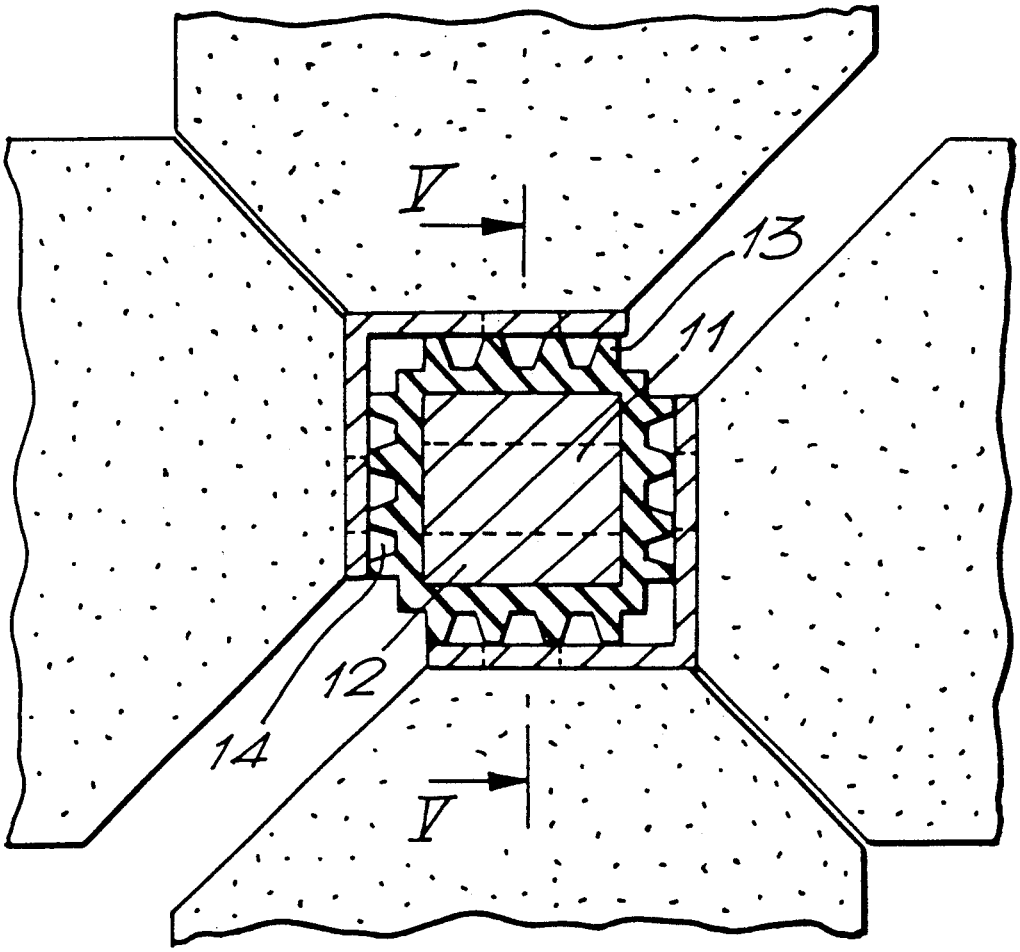
FIG. 4 is a section through the flexible connection parallel to the plane of the facing.
Figure 5:
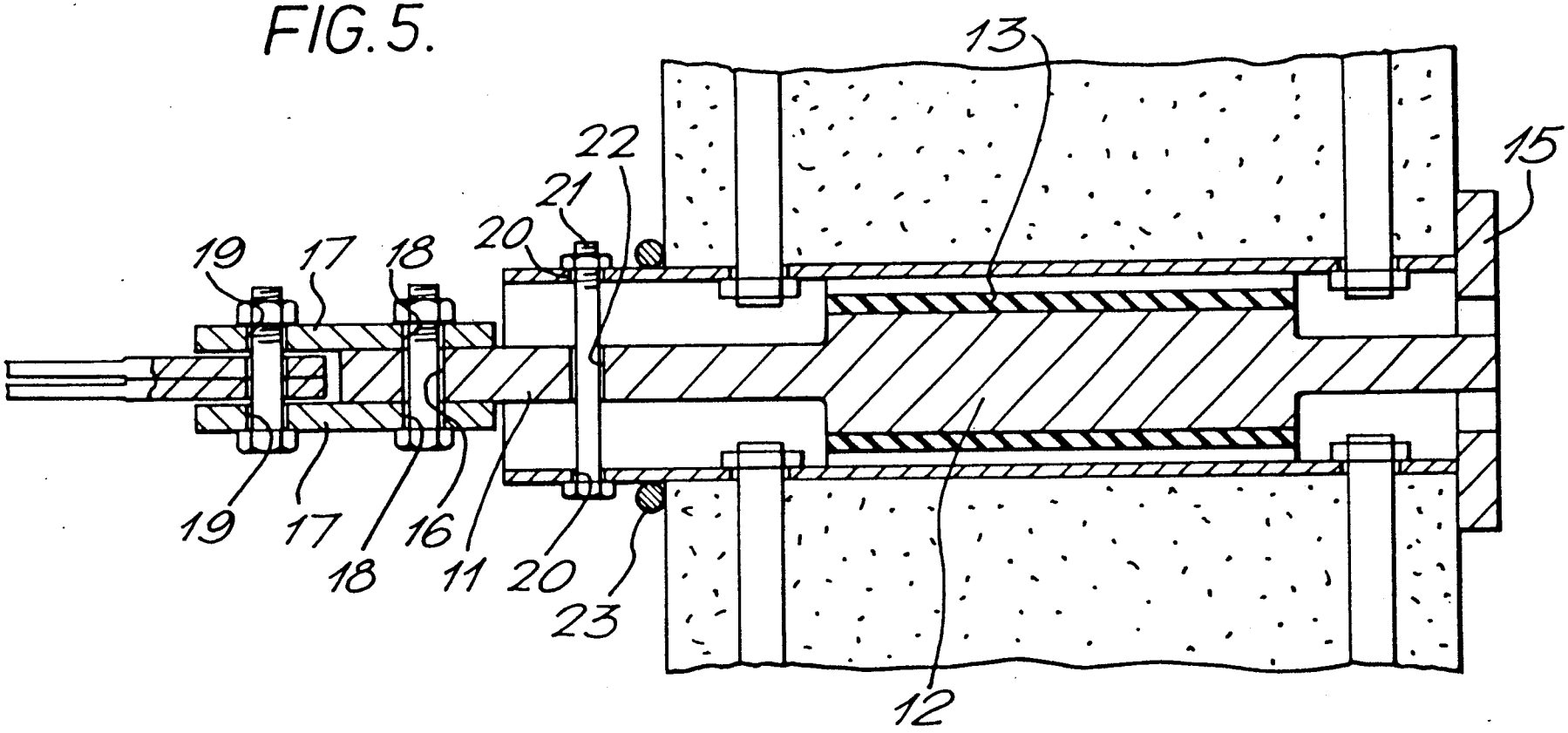
FIG. 5 is a section through the flexible connection perpendicular to the facing, on the lines V—V of FIG. 4.
Figure 6:
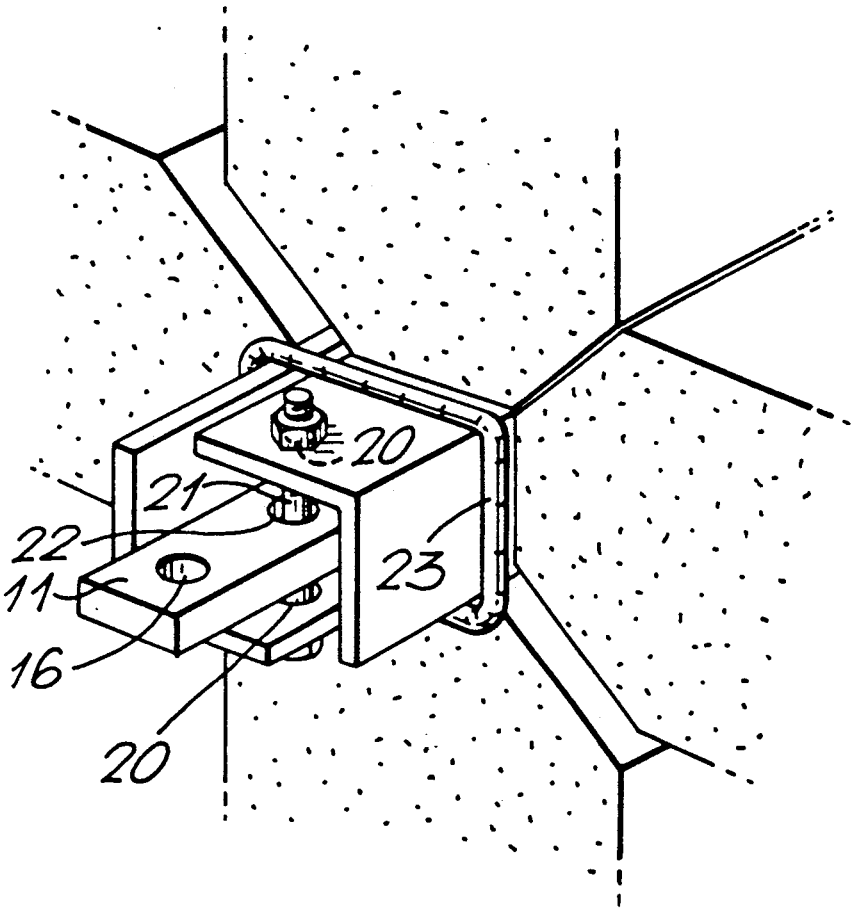
FIG. 6 is a perspective view of the flexible connection at the rear of the facing frames.
Figure 11:
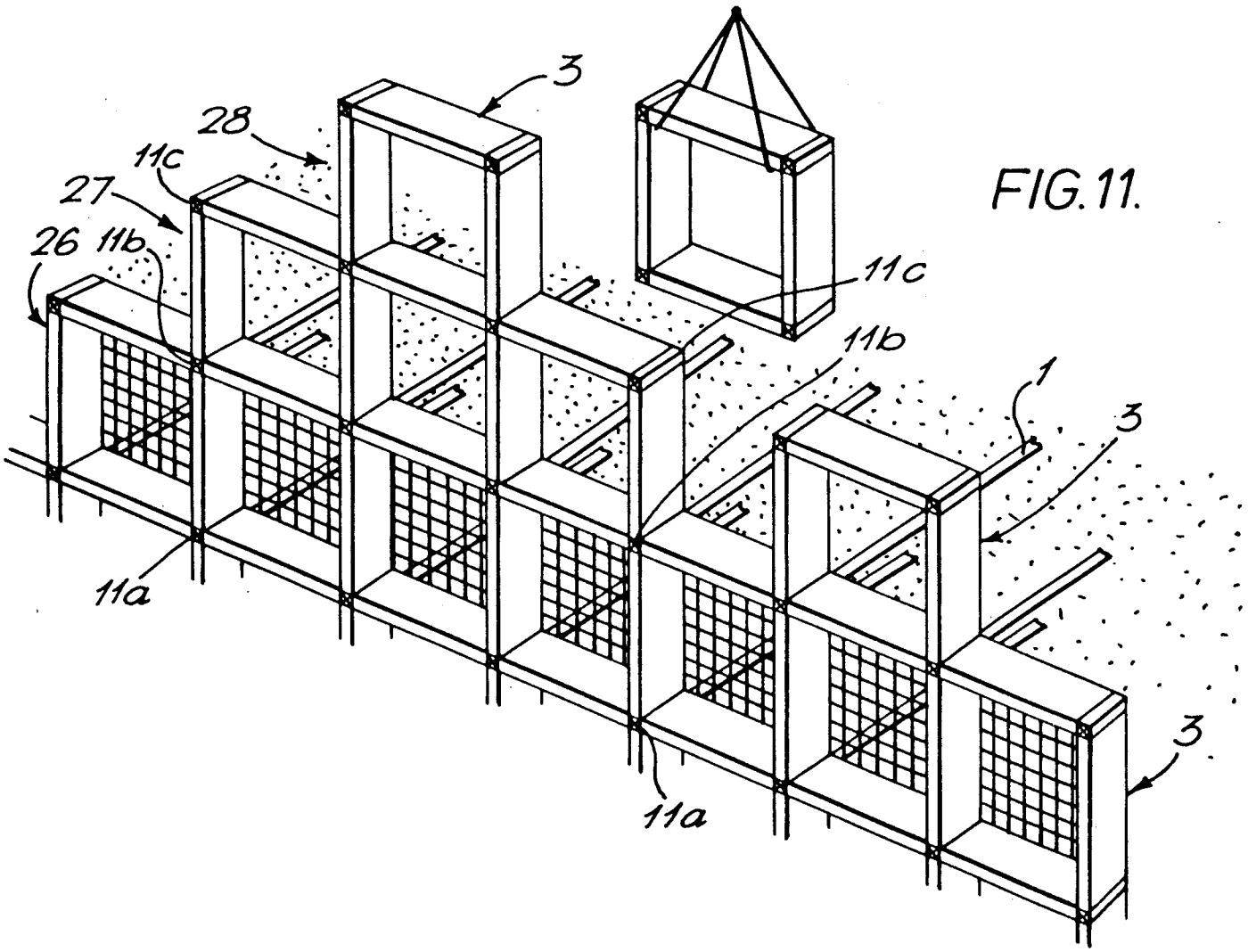
FIG. 11 is a perspective view of the structure during construction.

Referring to FIG. 1, the structure comprises elongate stabilizing elements 1 embedded in soil backfill 2, facing frames 3 each covered by a mesh cover 4, and joints 5 which connect each frame at its corners to respective stabilizing elements and which flexibly connect together the frames in an array, as seen in FIG. 11. From Figure 2 it will be seen that each facing frame 3 comprises four identical side members 6, preferably of reinforced concrete, which are connected at their ends by L-section brackets 7, preferably of steel. The brackets 7 are secured to the side members 6 by bolts 8 cast into the concrete. Each side member 6 is formed at its rear surface with a plurality of spaced grooves 9 each for receiving a respective element 10 of the mesh cover 4. A number of such side members may be conveniently cast in a single box in which are located spaced separators each formed with a row of projections for forming the grooves 9. More conveniently, the identical side members may be cast in an automatic press.

FIGS. 3 to 6 show the joint 5 in greater detail. The joint includes a steel nail 11 having a thickened shank portion 12 of generally square section around which a rubber sleeve 13 extends, the sleeve being formed with longitudinal grooves 14. At the front end of the nail 11 a head portion 15 is welded for engagement with the front face of the facing frames, while at its rear end the nail is formed with a vertical hole 16 enabling it to be bolted to a pair of vertically spaced plates 17 each having a corresponding hole 18. Each plate 17 is formed with a further hole 19 for bolting to the plates a reinforcement 1 (or in the case of FIG. 5, a pair of stabilizing elements. Each L-section bracket 7 extends rearwardly of the facing frame 3 and is formed with an aperture 20 in its horizontal portion, the brackets 7 being connected at each joint 5 by a bolt 21 extending through the apertures 20 and through an opening 22 formed in the nail 11. The bolt 21, along with a steel tie 23 extending around the rearwardly projecting portions of the brackets 7, serve to secure together the two facing frames 3 which meet at the joint, while permitting relative vertical movement of the frames in the plane of the facing. The rubber sleeve 13 is sufficiently flexible to allow such movement, the grooves 14 contributing to the flexibility.

Figure 7:
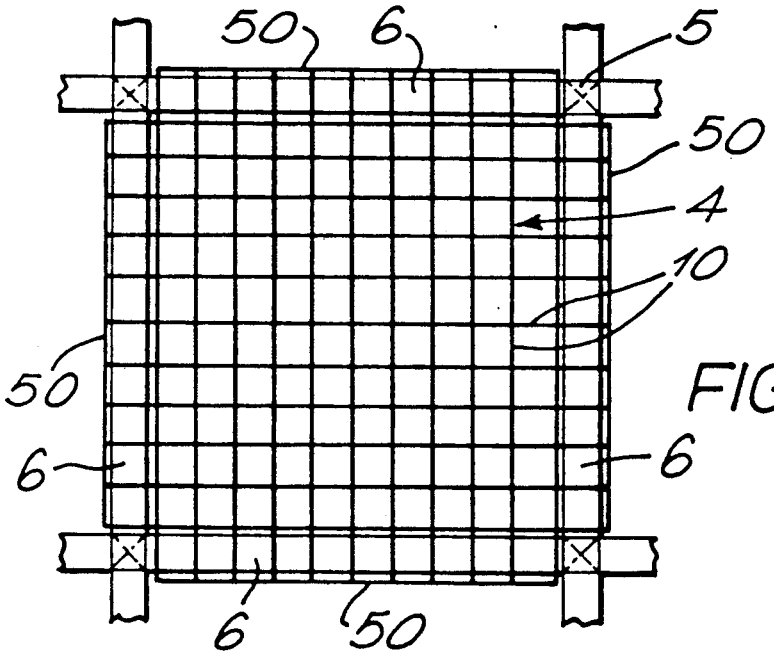
FIG. 7 is a rear elevation of a facing frame on which a cover in the form of a grid is mounted.
Figure 8:
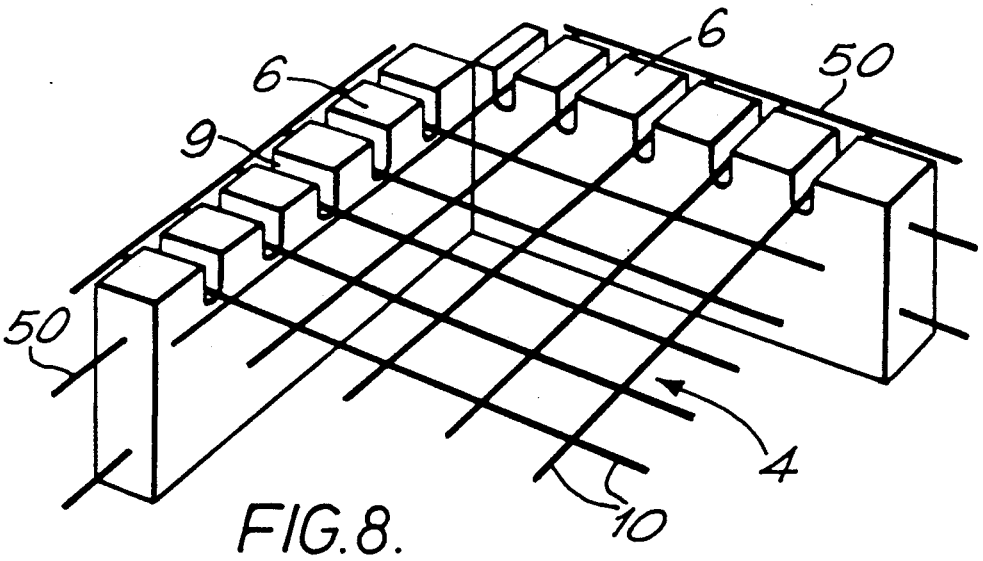
FIG. 8 is a cut away perspective view of part of the cover grid mounted on the facing frame.

FIGS. 7 and 8 illustrate the mesh cover 4 attached to each facing frame. The spaced grooves 9 each receive a respective element 10 of the mesh cover which is sufficiently flexible to deflect or bow forwardly under soil pressure, while being sufficiently strong to withstand such pressure without risk of collapse. A peripheral mesh element 50 is disposed outwardly of each side member perpendicular to the grooves 9 so as to restrain the mesh elements 10 passing through the grooves against tension generated by soil pressures. The peripheral mesh elements 50 may be at an initial spacing from the side members, so as to permit some forward deflection of the mesh cover before firmly anchoring the elements 10. For example, with a mesh cover on a frame of nominal diameter 1500 mm, the peripheral mesh elements may be initially about 6 mm from the frame side members, and the forward deflection of the mesh cover at its center may be about 70 mm, the elements of such mesh being steel members of 8 mm diameter. The grooves 9 formed in the side members of the facing frames are sufficiently deep to receive along their length two mesh cover elements 10, since when the facing frames are connected in an array each frame side member will engage with two adjacent mesh covers.

Alternative forms of cover for the facing frames are shown in FIGS. 9 and 10, these covers being relatively rigid and arranged to move forwardly 35 as a whole under soil pressure, rather than flexing as in the previously described embodiment. FIG. 9 shows a relatively thin, e.g. 60 mm reinforced concrete panel 55, in which the reinforcing bars 24 project outwardly at the panel edges to engage in the grooves 9 of the facing frame 3, these reinforcing bars being retained in position by peripheral elements 51 similar to those of the mesh cover embodiment. The connection of the reinforcing bars 24 to the frame enables the panel 55 to shift forwardly under soil pressure.

FIG. 10 shows another reinforced concrete panel 25 provided at the front of the frame, rather than the rear as in the FIG. 9 embodiment. Thus the outwardly projecting reinforcing bars 24 are of an increased length so as to reach the grooves 9 at the rear of the frame for their anchorage.

Various other modifications of the cover design are envisaged. One possibility is for the concrete panel to have one edge at the front of the frame and another parallel edge at the rear, thereby creating shadow effects on the facing. Where at least the lower part of the panel is at the rear of the frame, the lower side member of the frame provides a ledge which can be used to carry vegetation e.g. in a so-called window box. Another possibility is for each panel to be made up of a plurality of smaller panels interconnected e.g. by steel wires or bars, so as to create a mosaic effect. In a further modification, each facing frame 3 is formed with recesses on the inside faces of the side members, the cover having corresponding outward projections arranged to engage in the recesses in such a way as to permit forward movement of the cover. The projections of the cover may be concrete or they may be extended portions of reinforcing bars projecting outwardly of the body of the cover. In these arrangements the frames will normally 35 be prefabricated with their covers in position, prior to installation in the structure.

The construction of a preferred structure of the invention will be described with reference to FIG. 11. In the drawing, a row 26 of facing frames 3 is shown in position, each frame being spaced from the adjacent frames in the row by a distance corresponding to the frame width and resting on nails 11*a* provided at the corners of the frames of the underlying row of spaced frames. The nails 11 are provided with resilient bearing surfaces as described above and are attached to stabilizing elements 1 lying on the compacted soil. A further row of nails 11*b* is positioned at the upper corners of the frames of row 26, resting on the upwardly facing L-section brackets 7 of the frames. The frames of the next row 27 are then lowered into position thus joining the spaced frames of row 26 to form a continuous framework. At the rear of the abutting frames of rows 26 and 27 the ties 23 are secured by the bolts 21 so as to form a positive connection between the corners of frames at each joint, this connection helping to prevent forward tilting of the frames in row 27. This connection prevents the rear of the frames from lifting up, and in order to prevent the front of the frames from compressing the resilient bearings to the nails 11 to an excessive extent, a pair of pinch bars may be used to hold apart the brackets 7 at the front of the facing. Then the covers for the frames of row 26 are located in position. If the facing frames 3 are of the kind prefabricated with covers, then further covers will only be needed for the new frames created in row 26 by positioning the frames of row 27 to form the spaced upper corners of the frames of row 26. The row 26 is then backfilled with compacted soil up to the level of the nails 11*b* and the latter are attached to a further 35 layer of reinforcements 1 laid in the compacted soil. Nails 11*c* are then positioned on the frames of row 27 and frames of the next upwards row 28 lowered into position. Row 27 is then ready, after positioning of covers, for backfilling with compacted soil. This procedure is repeated with the addition of further sets of frames and backfilling the completed rows. Once row 28 of frames has been backfilled the reinforcements 1 extending from the nails 11*c* between the rows 27 and 28 will be secured and stabilize the frames of row 27 against forward tilting. At this point the pinch bars at the front of the joints between rows 26 and 27 may be removed.

Figure 12:
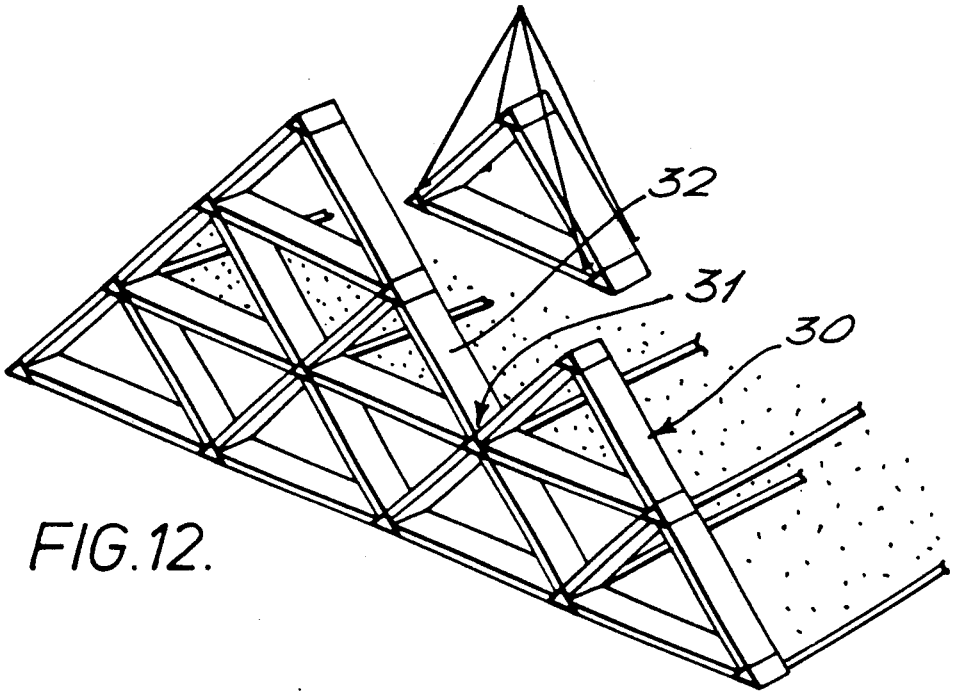
FIG. 12 is a perspective view showing construction of an embodiment having triangular facing frames.
Figure 13:
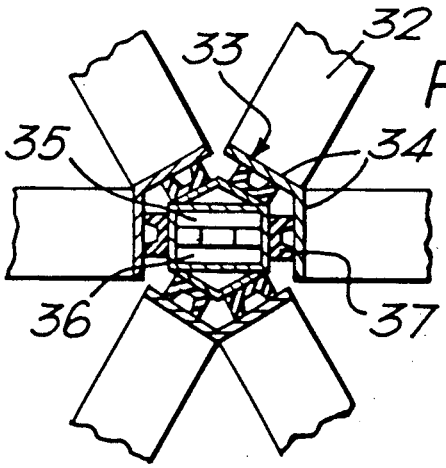
FIGS. 13 and 14 are sections through alternative forms of connection between the frames of Figure 12.
Figure 14:
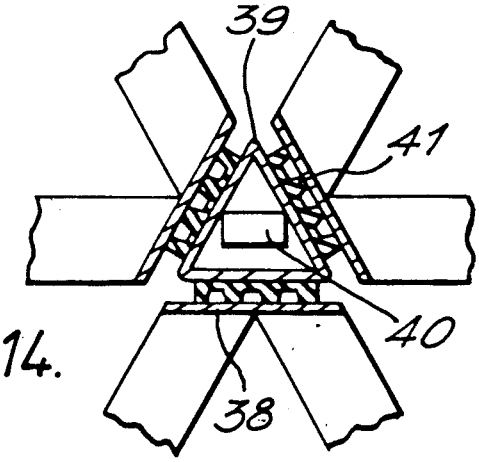

The structure shown under construction in FIG. 12 has triangular facing frames 30 so that three such frames meet at each joint 31 which may be formed as shown in FIG. 13 or FIG. 14. In the arrangement of FIG. 13, the side members 32 of the frames are secured together by being bolted to V-section brackets 33 having legs 34 at 120° to each other. A shank 35 of a nail 36 has a box-section to which are welded upper and lower V-plates to form six outer faces of the shank. On each face is provided a rubber spacer 37 against which bears a respective leg 34 of the brackets 33. The brackets have rearwardly projecting portions which, as in the square frame embodiment, may be connected together to avoid forward tilting of the frames during construction.

In the arrangement of FIG. 14, instead of using V-section brackets to connect the side members of the frames, flat plates 38 are used. The shank 39 of the nail 40 is of triangular section and on each face of the shank a rubber spacer 41 is provided. The ends of the side members are appropriately shaped for this type of connection.

FIG. 15 shows an embodiment in which the facing frames 60 are flexibly connected without the use of the nails referred to previously. In this case each frame 60 is secured at its corner by a diagonal plate 61 attached to the frame side members 62 by bolts 63 protruding from the side members. A pair of resilient spacers 64, e.g. of rubber, are disposed between the two plates to provide a flexible connection, the spacers being formed with grooves 65 running perpendicular to the plane of the facing to improve flexibility.

In the embodiment shown in FIG. 16, the lower corners of the upper frame 3C are provided with steel channel members 42 which cooperate with elongate lugs 43 provided on the upper corners of two lower frames 3A and 3B. Resilient means 44, for example rubber bearings or spring elements, are provided between the corners to absorb vertical movement of the frames.

In the embodiment shown in FIG. 17, the abutting frames 3A and 3C are provided with L-shaped channel members 45 having bearing surfaces 46. The bearing surfaces 46 of the lower frame 3A is provided with a pin 47 which engages with a hole 48 in the bearing surface 46 of the upper frame, thereby assisting location of the frames during assembly while permitting some lateral movement. A rubber bearing 49 is provided between the surfaces 46 in order to absorb vertical forces.

In the embodiment shown in FIGS. 18, 19 and 20 the side members 6 of the frame are narrower at the rear than at the front, thus presenting angled rear surfaces 6A which assist establishment of compressive arching forces indicated by dotted lines. A cover is provided as shown in Figure 20 which is constructed from concrete . A resilient block 120 is provided between the angled side of the cover and the angled side of the frame. The dimensions of the cover are such as to allow a forward movement of the cover of about 2 cm.

In the embodiment shown in FIGS. 21, 22, 23 and 24 the corners of the frame are provided with brackets 7 which serve to connect the side members via bolts and which further carry bearing surfaces 150 and 151 provided with resilient bearings 152 and 153. Lugs 154 and 155 are provided which cooperate like hooks to assist location of the frames during assembly while allowing some lateral movement. The brackets 7 extend rearwards and forwards of the frames and are provided with holes 156 and 157 which are adapted to engage with bolts joining the abutting channel members 6 of vertically adjacent frames; this serves to hold the upper frames in the vertical position during assembly, when they are otherwise unsupported. Further holes 58 are provided which may be bolted to stabilizing elements such as strips embedded in the earth.

In the embodiment shown in FIG. 25, the side member 75 of a frame is provided with slots 76. A cover 77 constructed from concrete cast on wire mesh 78 has side elements of the mesh 79 which engage in the slots 76 and which are so shaped as to bend under the forward movement of the cover due to earth pressure.

Figure 26:
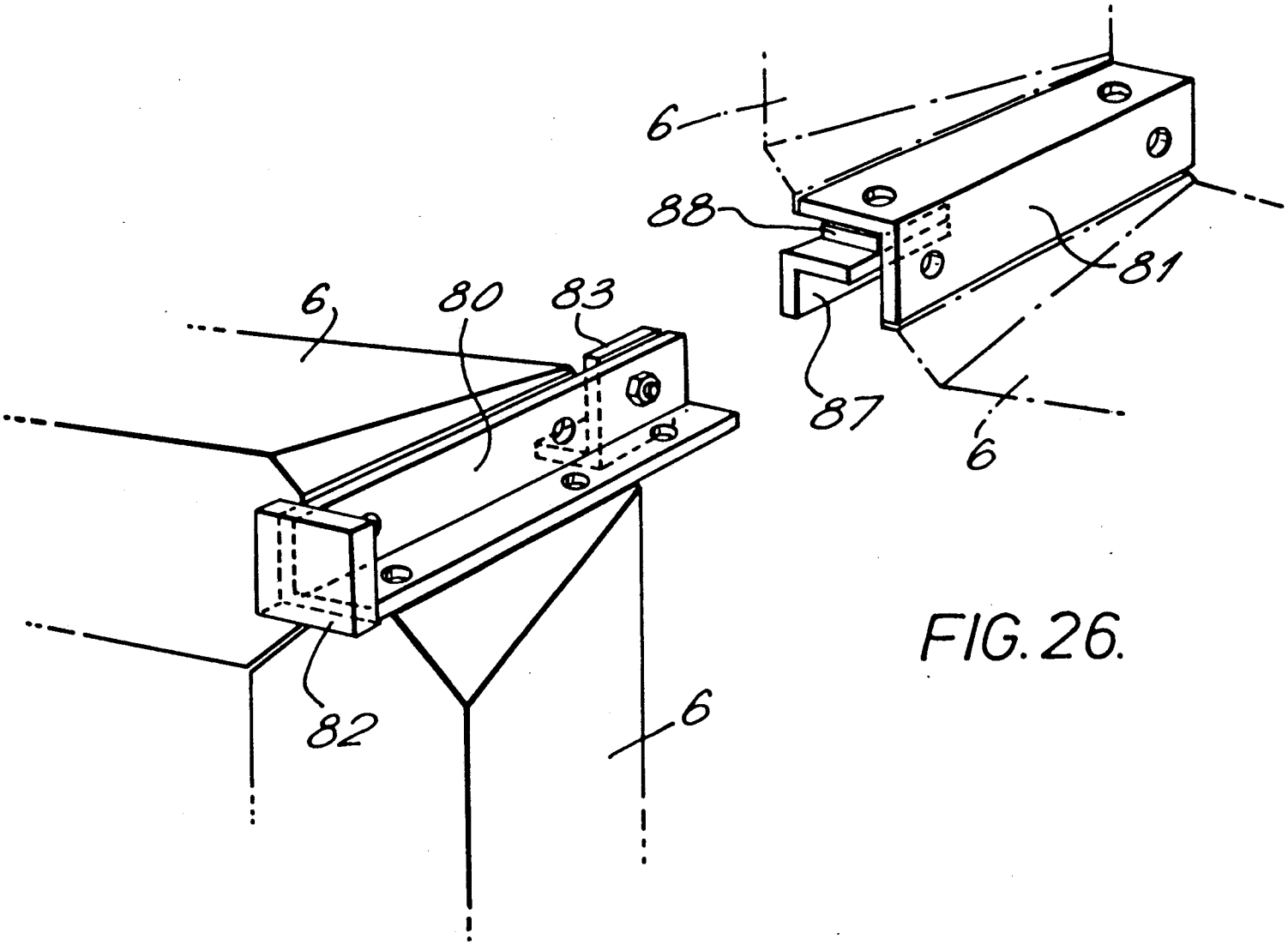
FIG. 26 shows a perspective view of another form of flexible connection, with certain parts omitted for clarity.
Figure 27:
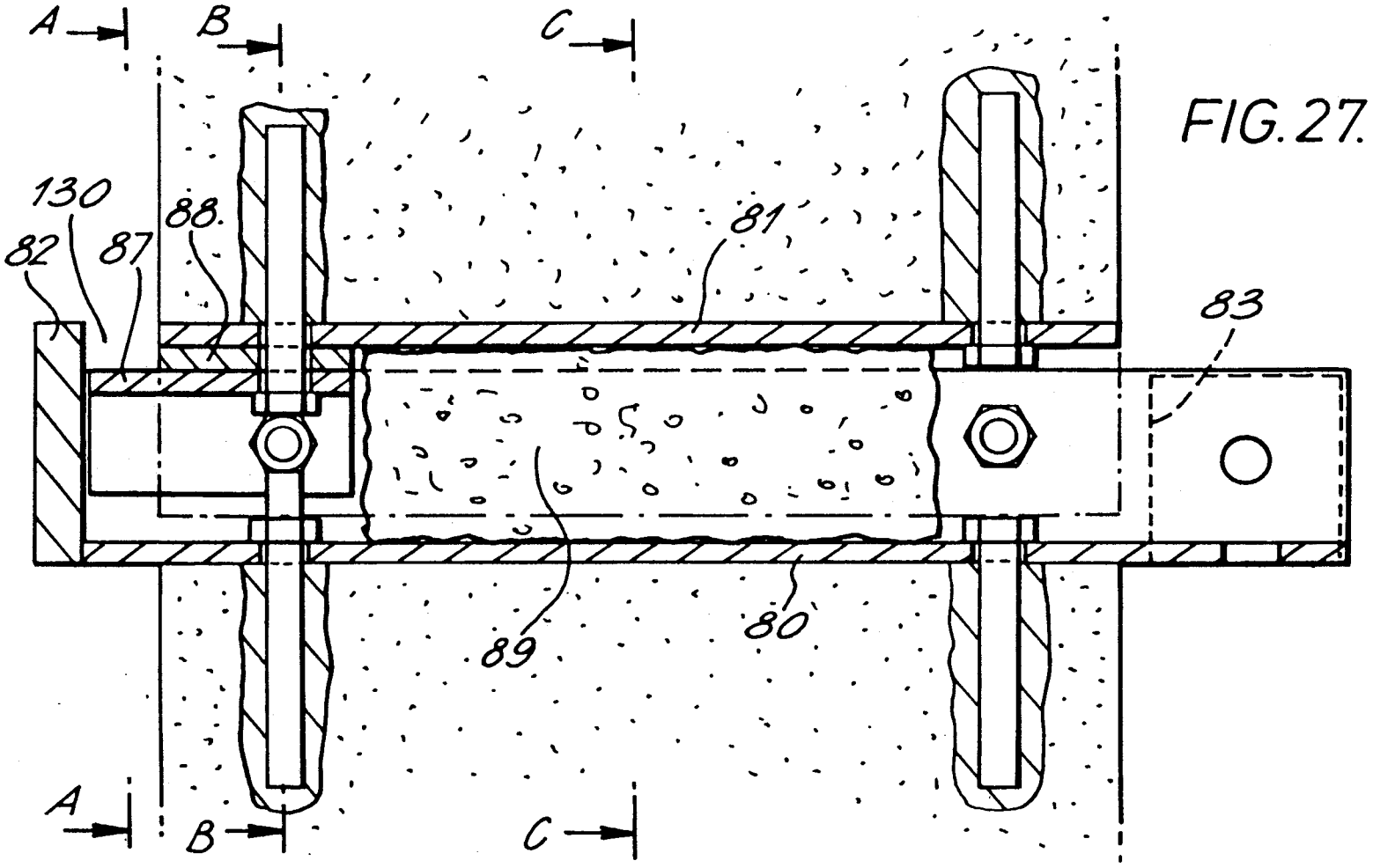
FIG. 27 shows a longitudinal section in a vertical plane through the connection of Figure 26.
Figure 29:
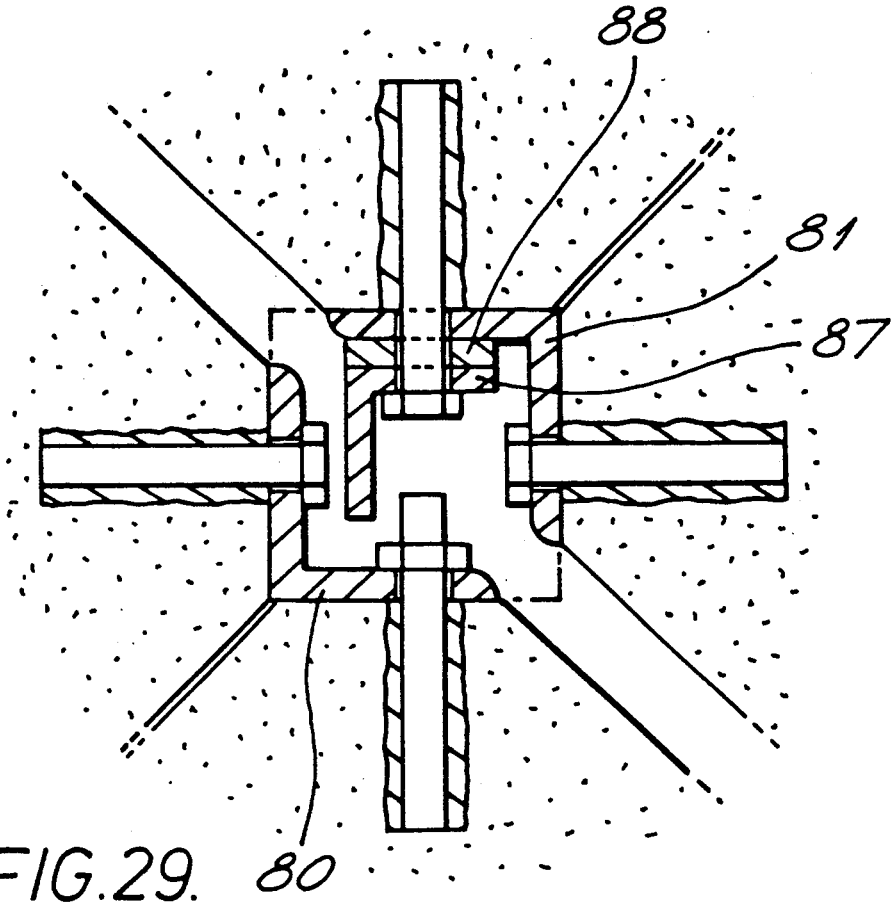
FIGS. 28, 29 and 30 respectively show sections on the line A—A, B—B and C—C of FIG. 27.
Figure 28:
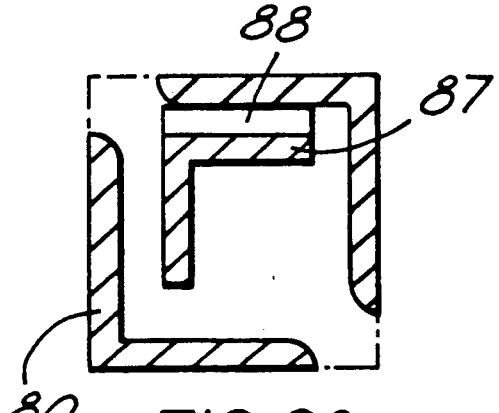

Referring to FIG. 26, this shows a pair of facing frames similar to the frame of Figure 18 and having side members 6 narrower at the rear than at the front. The flexible connection between the frames consists of an L-section bracket 80,81 bolted to each frame, as seen in FIGS. 27 and 29. The attachment means for a stabilizing element or elements at the rear of the frames includes a relatively short bracket 83 also of L-shaped cross section bolted to the rear of the lower L-section bracket 80 to form an inverted T-shaped rear projection, as seen in FIG. 31. A pair of connecting plates 84 fit above and below the cross bar of the "T" formed by the brackets. The connecting plates are formed with suitable holes for bolting to the brackets and the upper connecting plate 84 is formed with a slot 85 for receiving the vertical portions of the brackets. A hole 86 is formed through the rear part of each connecting plate to receive a bolt for connection of a stabilizing element. Instead of a single hole 86 a pair of laterally spaced holes may be provided for connection of a pair of stabilizing elements.

Figure 30:
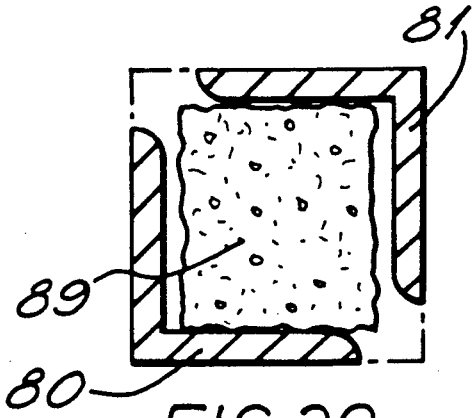

As shown in FIGS. 26 to 29, the upper bracket 81 of the upper facing frame has bolted thereto a relatively short L-section bracket 87 with a spacer plate 88 arranged between the two brackets The bracket 87 projects forwardly so as to abut against a front plate 82 secured, e.g. by welding, to the lower bracket 80 and to define a space 130 between the front face of the upper frame and the front plate 82. As seen in FIGS. 27 and 30 a resilient block 89, e.g. of rubber, fits between the lower and upper brackets 80,81 to provide a flexible connection between the frames. The resilient block could alternatively be replaced by a C-shaped spring of steel or the like arranged to permit resilient relative movement between the frames.

Thus in the embodiment of FIGS. 26 to 31 the rear of the lower bracket 80 is secured to one or more stabilizing elements embedded in the earth backfill, thereby securely locating the lower frame, while the short front bracket 87 connected to the upper bracket 81 abuts against the front plate 82 of the lower bracket 80, thereby securely locating the upper frame. By this arrangement the frames are secured to the stabilizing elements and restrained against forward movement, while the resilient block 89 permits relative movement of the frames in the plane of the facing.

The purpose of the space 130 between the upper frame and the front plate 82 will be described with reference to FIGS. 32 and 33 which show a device 90 used during construction to ensure that a frame 91 of an upper row of frames does not tilt forwardly. The device 90 comprises an elongate member 92 having at its upper and lower ends abutment plates 93 arranged to engage the front of the facing in the region of the flexible connections, as seen in FIG. 33. Midway of its length the device 90 has a hook member 94 with a downwardly projecting portion 95 arranged to engage in the space 130 between the upper frame 91 and the front plate 82 of the lower bracket 80. During construction as shown in FIG. 33, the top part of the frame 91 is restrained against forward movement by the device 90 which is secured to the facing by the hook member 94. The device may be removed once the stabilizing elements at the top of the frame 91 have been backfilled, thereby permanently securing the top of the frame 91.

Figure 36:
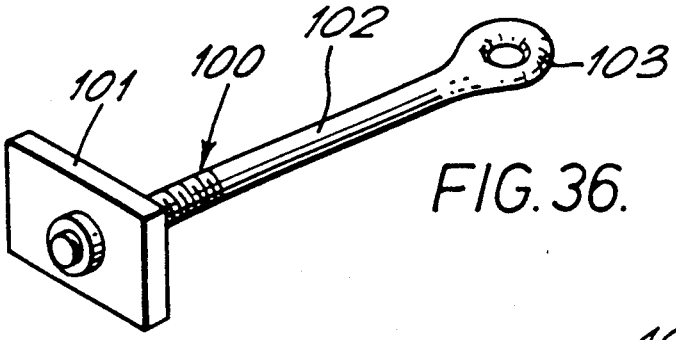
FIG. 36 shows a nail for use in the connection of FIGS. 34 and 35.

In the arrangement shown in FIG. 34 the side members 97 of the frame 96 are each provided with a pair of U-shaped lugs 98 which can conveniently be formed as part of the conventional reinforcing bars of the side members. Adjacent side members are held together by a bar 99 which passes through the two lugs of each side member. As seen in Figure 35 two such frames 96 are connected together at their corners with a resilient block 160 arranged therebetween to permit relative movement between the frames. The connection is completed by a nail 100, shown in FIG. 36, which has a front plate 101 for abutment against the front faces of the frame side members and a widened rear portion 103 having a vertical hole for attachment to a stabilizing element. The front plate 101 should be of a size sufficient to ensure that its abutment area with these front faces is large enough to accommodate stresses caused by forwardly acting earth pressures on the frames. The shank 102 of the nail 100 is of circular cross section and is arranged to screw into a hole in the front plate 101 once the shank has been threaded through a central hole 104 in the resilient block.

The nail 100 may alternatively have a shank of uniform rectangular cross section which may be threaded through a correspondingly shaped hole in the resilient block. At the front of such a rectangular nail a front plate may be welded, so that the nail is installed by threading through the staples in the direction from the front to the rear of the facing. It will thus be seen that in the arrangement of FIGS. 34 to 36 significantly less steel is used at the flexible connection between frames than in the previously described embodiment.

Figure 37:
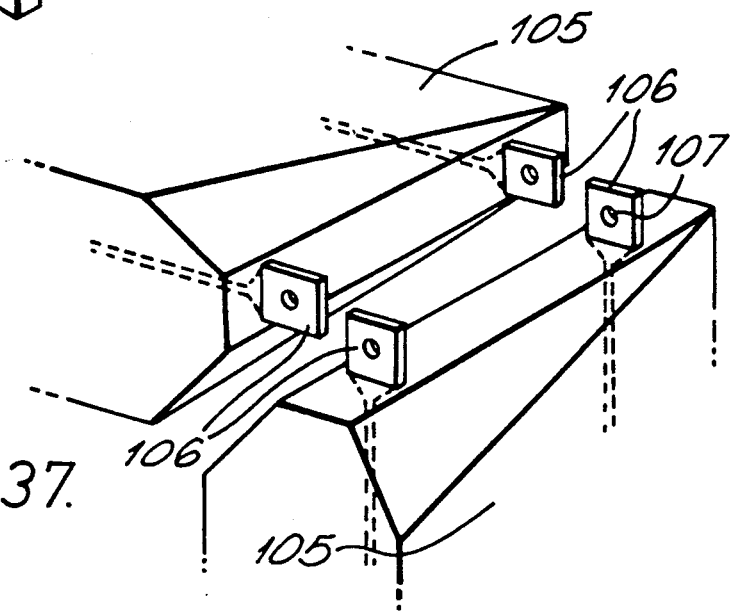
FIG. 37 shows a perspective view of part of another form of flexible connection.
Figure 38:
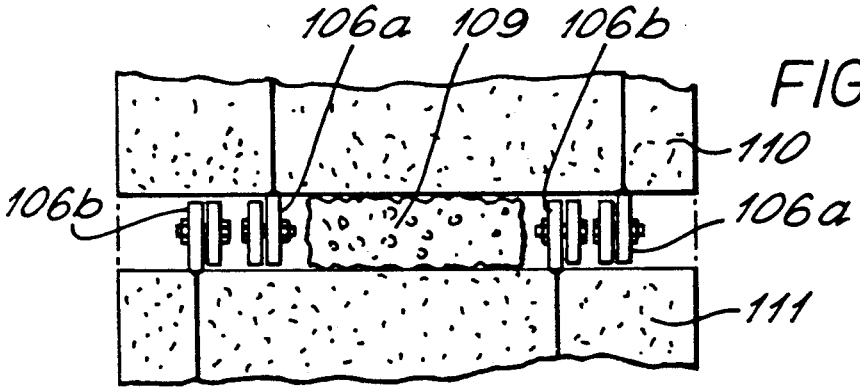
FIG. 38 shows a vertical section through the connection of FIG. 37.

In the embodiment shown in FIGS. 37 and 38 each frame consists of four side members 105 each having at its opposite ends a pair of plate-like attachment lugs 106. These lugs, preferably of steel, are provided integrally on the ends of members embedded in the concrete side member and each lug has a hole 107 therethrough for passage of a bolt 108 for securing together adjacent side members 105 of a frame.

FIG. 38 shows how the attachment lugs 106 of upper and lower frames 110 and 111 fit together at the flexible connection with a resilient block 109 located in the space defined by the ends of the side members. The two pairs of lugs designated 106*a* secure together the side members of the upper frame 110 and the two pairs of lugs designated 106*b* secure together the side members of the lower frame 111. As seen in FIG. 38 the lugs 106*a* and 106*b* associated with the respective frames are offset from each other along the axis of the connection so that the lugs nest together substantially coaxially. In such an arrangement the frames will normally be connected to stabilizing elements at points on the side members spaced away from the flexible connections between frames, described in more detail hereinafter.

In the embodiment of FIGS. 37 and 38, each side member is formed with a pair of attachment lugs 106, but in an alternative arrangement each side member may instead be provided with a single lug. Each lug may be formed by a U-shaped bent plate having its bent portion embedded in the frame side member and its two end portions spaced apart and projecting from the side member, possibly with the space between the plates filled in with concrete to form a block-shaped lug.

Apart from rectangular or triangular facing frames, other shapes may be provided, such as parallelograms. One possible frame is in the form of a parallelogram with sides at 60° to the horizontal and with the lateral spacing between the joints being equal to the height of the frame, so that the vertical spacing between layers of reinforcements is equal the horizontal spacing of the reinforcements.

The facing of the structure may be vertical with a generally flat or alternatively a curved or angled profile in plan view. In each case the shape of the frames at the joints will be appropriately designed. In an alternative embodiment the facing of the structure might be at an angle to the vertical, for example about 30°, with joints between adjacent frames extending generally horizontally. There will be a significant tendency for the facing frames in such a structure to tilt rearwardly before they have been backfilled, and this may be prevented by bolting together the brackets of the frames in adjacent rows at the front of the facing, in addition to the previously described bolted connections at the rear. The stabilizing elements in such a structure will also extend generally horizontally.

The stabilizing elements will normally be in the form of elongate, galvanized steel strips (e.g. having a rectangular cross-section 5 mm thick by 40 mm wide) with their larger faces lying horizontally in the earth. In some cases, the reinforcing strips may each be provided with a ground anchor, e.g. a vertical plate, at their ends remote from the facing, and while this assists anchorage of the strip, the earth in the region of the facing will still be stabilized by the frictional forces between soil particles and the strip itself. The strips may be provided on their upper and lower faces with transverse ridges to assist frictional interaction with the earth. The stabilizing elements may alternatively take the form of a metal mesh or plastic net or the like. A further possibility is that a single stabilizing element extending rearwardly from the facing may be connected to a pair of further stabilizing elements which extend rearwardly and diverge from each other.

The connection between each stabilizing element and the facing may be arranged to permit relative vertical movement between the stabilized earth in which the stabilizing element is embedded and the facing element to which the stabilizing element is connected. Such a connection may for example comprise a pair of horizontally spaced joints allowing pivotal movement in a vertical plane.

The stabilizing elements have generally been described herein as being connected to the facing at the joints between facing frames. However, the stabilizing elements may instead be secured to the side members at points away from the joints. For example, a square facing frame may have two stabilizing elements secured to each side member respectively one third and two thirds of the distance along its length, the frame thus having altogether eight stabilizing elements extending therefrom. The stabilizing elements may be secured to plates cast into and projecting from reinforced concrete side members.

While this invention has been illustrated and described in accordance with a preferred embodiment it is recognized that variations and changes maybe made and equivalents employed herein without departing from the invention as set forth in the claims.

I claim:

1. A facing for an earthwork comprising an array of polygonal frames arranged substantially in a plane, said frames being substantially rigid, said array being provided with means for attachment to said earthwork substantially to prevent movement of said frames perpendicularly to the plane of the facing, and flexible means located at the corners of the frame for connection to corners of adjacent frames to allow independent movement of each frame in the plane of the facing relative to said adjacent frames, the frames being positioned in horizontal rows and being connected to one another only at their corners, the frames in each horizontal row of frames being spaced apart laterally by one frame width and the frames in a vertically adjacent row being joined to corners of said spaced frames.

2. A facing as claimed in claim 1, in which the means for attachment are secured to the ends of stabilizing elements embedded in said earthwork.

3. A facing as claimed in claim 2, in which the stabilizing elements are reinforcing strips.

4. A facing as claimed in claim 2, in which the stabilizing elements are soil nails.

5. A facing as claimed in claim 1, wherein the allowed movement of each frame in any direction in the plane of the facing is at least about 0.5% of the dimension of the frame in that direction.

6. A facing as claimed in claim 1, wherein said frames include a plurality of side members having aback and a front ad wherein the side members of the frames are narrower at the back than at the front.

7. A facing as claimed in claim 1, wherein the polygonal frames are provided with covers which serve to retain the soil, such covers being capable of resilient movement relative to the frame in th direction perpendicular to the frame, at least over the greater part of their area, while resisting the pressure of the soil.

8. A facing as claimed in claim 7, wherein the covers are able to move in the perpendicular direction at least about 0.5% of the length of each side of the frame.

9. A facing as claimed in claim 7, wherein the cover includes a plurality of lateral resilient projections which engage in slots provided in the rear surfaces of the frames to locate the covers in the frames while permitting resilient forward movement.

10. The facing according to claim 1, in which the frames are provided with rearward projections which are so positioned as to be adjacent to corresponding projections of vertically adjacent frames and means are provided to secure said projections to prevent forward rotation of said frames.

11. A facing as claimed in claim 1, wherein said frames include a plurality of side members and wherein said means for attachment comprises rearward projections extending from the side members of the frames.

12. An earth structure having a facing as claimed in claim 1 secured thereto.

13. A facing as claimed in claim 1, wherein each of said frames includes a plurality of side members that surround an open central area.

14. The facing according to claim 10, in which the frames are provided with forward projections which are so positioned as to be adjacent to corresponding projections of vertically adjacent frames and mean are provided to secure said projections to prevent backward rotation of said frames.

15. The facing according to claim 1, wherein said means for attachment includes rearward extensions of bearing surfaces secured to the corners of the frames.

16. The facing according to claim 1, wherein said means for attachment includes rearward extensions of bearing means positioned between bearing surfaces at the corners of the frames.

17. A facing for an earthwork comprising an array of polygonal frames arranged substantially in a plane, said frames being substantially rigid, said array being provided with means for attachment to said earthwork substantially to prevent movement of said frames perpendicularly to the plane of the facing, and flexible means located at the corners of the frames for connection to corners of adjacent frames to allow independent movement of each frame in the plane of the facing relative to said adjacent frames, the frames being positioned in horizontal rows and being connected to one another only their corners, the corners of the frames being provided with locating means which cooperate with the corners of vertically adjacent frames to provide limited lateral movement while assisting in locating the frames in their correct positions during assembly.

18. The facing according to claim 17, wherein said means for attachment are secured to the ends of stabilizing elements embedded in the earthwork and wherein said stabilizing elements are reinforcing strips.

19. A facing for an earthwork comprising an array of polygonal frames arranged substantially in a plane, said frames being substantially rigid, said array being provided with means for attachment to said earthwork substantially to prevent movement of said frames perpendicularly to the plane of the facing, and flexible means located at the corners of the frames for connection to corners of adjacent frames to allow independent movement of each frame in the plane of the facing relative to said adjacent frames, the frame being positioned in horizontal rows and being connected to one another only at their corners, the corners of the frames being provided with bearing surfaces provided with resilient bearing means.

20. A facing as claimed in claim 19, in which said resilient bearing means are constructed from resilient material.

21. The facing according to claim 19, wherein said means for attachment are secured to the ends of stabilizing elements embedded in the earthwork.

22. The facing according to claim 21, wherein said stabilizing elements are reinforcing strips.

23. The facing according to claim 21, wherein said stabilizing elements are soil nails.

24. The facing according to claim 19, wherein the allowed movement of each frame in any direction in the plane of the facing is at least about 0.5% of the dimension of the frame in that direction.

25. The facing according to claim 19, wherein said frames include side members having a back and a front, said side members of the frames being narrower at the back than at the front.

26. The facing according to claim 19, wherein said frames are provided with rearward projections which are so positioned as to be adjacent to corresponding projections of vertically adjacent frames, and including means for securing said projections to prevent forward rotation of said frames.

27. The facing according to claim 26, wherein said frames are provided with forward projections which are so positioned as to be adjacent to corresponding projections of vertically adjacent frames, and including means for securing said projections to prevent backward rotation of said frames.

28. The facing according to claim 19, wherein said frames include side members and wherein said means for attachment includes rearward projections extending from said side members.

29. The facing according to claim 19, wherein said means for attachment includes rearward extensions of bearing surfaces secured to the corners of the frames.

30. The facing according to claim 19, wherein said means for attachment includes rearward extensions of bearing means positioned between bearing surfaces of the corners of the frames.

31. An earth structure having a facing as claimed in claim 19 secured thereto.

32. The facing according to claim 19, wherein each of said frames includes a plurality of side members that surround an open central area.

33. A facing for an earthwork comprising an array of polygonal frames arranged substantially in a plane, said frames being substantially rigid, said array being provided with means for attachment to said earthwork substantially to prevent movement of said frames perpendicularly to the plane of the facing, and flexible means located at the corners of the frames for connection to corners of adjacent frames to allow independent movement of each frame in the plane of the facing relative to said adjacent frames, and including a plurality of nails, each of said nails having a shank which carries resilient bearing means that engage with shaped surfaces at the corner of the frames to permit movement and a head portion that engages a front of each frame to prevent forward movement perpendicular to the plane of the facing.

34. The facing according to claim 33, wherein said means for attachment are secured to the ends of stabilizing elements embedded in the earthwork and wherein said stabilizing elements are reinforcing strips.

35. A facing for an earthwork comprising an array of polygonal frames arranged substantially in a plane, said frames being substantially rigid, said array being provided with means for attachment to said earthwork substantially to prevent movement of said frames perpendicularly to the plane of the facing, and flexible means located at the corners of the frames for connection to corners of adjacent frames to allow independent movement of each frame in the plane of the facing relative to said adjacent frames, said frames being provided with covers for retaining the soil, said covers being capable of resilient movement relative to the frame in the direction perpendicular to the frame, at least over the greater part of their area, while resisting pressure of the soil.

36. The facing according to claim 35, wherein said means for attachment are secured to the ends of stabilizing elements embedded in the earthwork and wherein said stabilizing elements are reinforcing strips.

* * * * *